US008336630B2

(12) United States Patent
Kerr

(10) Patent No.: US 8,336,630 B2
(45) Date of Patent: Dec. 25, 2012

(54) SUBSEA WELL PRODUCTION SYSTEM

(75) Inventor: John A. Kerr, St Nom la Breteche (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 514 days.

(21) Appl. No.: 12/400,078

(22) Filed: Mar. 9, 2009

(65) Prior Publication Data

US 2009/0229830 A1 Sep. 17, 2009

Related U.S. Application Data

(60) Provisional application No. 61/036,704, filed on Mar. 14, 2008.

(51) Int. Cl.
*E21B 17/01* (2006.01)
*E21B 34/04* (2006.01)

(52) U.S. Cl. ..... 166/352; 166/340; 166/344; 166/367; 166/373; 405/224.2

(58) Field of Classification Search ..... 166/352, 166/339, 340, 344, 363–365, 367–369, 373–375, 166/377, 381, 386, 321, 324, 332.3, 332.7, 166/332.8; 405/224.2–224.4
See application file for complete search history.

(56) References Cited

U.S. PATENT DOCUMENTS

| | | | | | |
|---|---|---|---|---|---|
| 3,602,303 | A | * | 8/1971 | Blenkarn et al. | 166/360 |
| 3,970,147 | A | * | 7/1976 | Jessup et al. | 166/374 |
| 4,044,829 | A | * | 8/1977 | Jessup et al. | 166/264 |
| 4,253,525 | A | * | 3/1981 | Young | 166/336 |
| 4,445,571 | A | | 5/1984 | Hushbeck | |
| 4,494,609 | A | * | 1/1985 | Schwendemann | 166/336 |
| 4,658,904 | A | * | 4/1987 | Doremus et al. | 166/336 |
| 4,693,315 | A | * | 9/1987 | Taylor | 166/336 |
| 4,732,214 | A | * | 3/1988 | Yates | 166/336 |
| 4,880,060 | A | * | 11/1989 | Schwendemann et al. | 166/336 |
| 5,771,974 | A | * | 6/1998 | Stewart et al. | 166/336 |
| 5,782,304 | A | * | 7/1998 | Garcia-Soule et al. | 166/356 |
| 5,860,478 | A | * | 1/1999 | Coutts et al. | 166/356 |
| 5,884,703 | A | * | 3/1999 | Garcia-Soule et al. | 166/356 |
| 5,884,707 | A | * | 3/1999 | Garcia-Soule et al. | 166/356 |
| 5,884,708 | A | * | 3/1999 | Garcia-Soule et al. | 166/356 |
| 5,894,890 | A | * | 4/1999 | Garcia-Soule et al. | 166/356 |
| 6,026,905 | A | * | 2/2000 | Garcia-Soule | 166/336 |
| 6,125,938 | A | * | 10/2000 | Garcia-Soule et al. | 166/344 |
| 6,253,854 | B1 | * | 7/2001 | Fenton | 166/364 |
| 6,293,344 | B1 | * | 9/2001 | Nixon et al. | 166/363 |
| 7,086,467 | B2 | * | 8/2006 | Schlegelmilch et al. | 166/298 |
| 7,114,571 | B2 | * | 10/2006 | Gatherar et al. | 166/367 |
| 7,225,873 | B2 | * | 6/2007 | Schlegelmilch et al. | 166/298 |
| 7,647,974 | B2 | * | 1/2010 | Fenton | 166/368 |
| 2009/0236100 | A1 | * | 9/2009 | Lawson | 166/339 |

OTHER PUBLICATIONS

Schlumberger, SenTREE 7 Subsea Completion Test Tree.
International Search Report, Application No. PCT/US2009/036468 dated May 4, 2009.

* cited by examiner

*Primary Examiner* — Matthew Buck
(74) *Attorney, Agent, or Firm* — Bud Ehrlich; Chad Sullivan; Rodney Warfford

(57) ABSTRACT

A subsea completion testing tree (SCTT) for connection in a tubular string includes a lower tree portion having a control valve; an upper tree portion separably connected to the lower tree portion at a latch; a circulation valve connected with the upper tree portion; and a retainer valve connected with the upper tree portion between the circulation valve and the latch.

20 Claims, 2 Drawing Sheets

SUBSEA WELL PRODUCTION SYSTEM

RELATED APPLICATIONS

This application claims the benefit of U.S. Provisional Patent Application No. 61/036,704 filed Mar. 14, 2008.

TECHNICAL FIELD

The present invention relates in general to well drilling and production operations and more specifically to subsea well control equipment and methods.

BACKGROUND

Offshore systems (e.g., lakes, bays, seas, oceans etc.) often include a riser which connects a surface vessel's equipment to a blowout preventer stack on a subsea wellhead. Offshore systems which are employed for well testing operations also typically include a safety shut-in system which automatically prevents fluid communication between the well and the surface vessel in the event of an emergency, such as when conditions in the well deviate from preset limits. Typically, the safety shut-in system includes a subsea test tree which is landed inside the blowout preventer stack on a pipe string. The subsea test tree generally includes a valve portion which has one or more normally closed valves that can automatically shut-in the well. The subsea test tree also includes a latch portion which enables the portion of the pipe string above the subsea test tree to be disconnected from the subsea test tree.

SUMMARY

An embodiment of a subsea completion testing tree (SCTT) for connection in a tubular string includes a lower tree portion having a control valve; an upper tree portion separably connected to the lower tree portion at a latch; a circulation valve connected with the upper tree portion; and a retainer valve connected with the upper tree portion between the circulation valve and the latch.

An embodiment of a subsea well production system includes a subsea completion tree having an upper tree portion and a lower tree portion separably connected at a latch, the lower tree portion landed at a blowout preventer stack at a sea floor; an upper portion of a tubular string extending from a vessel to the upper tree portion; a lower portion of a tubular string extending into a well and in fluid connection with the lower tree portion, wherein an internal bore is formed through the tubular string and the subsea completion tree; a control valve connected in the internal bore with the lower tree portion; a retainer valve connected in the internal bore with the upper tree portion; and a circulation valve connected in the internal bore with the upper tree portion, the circulation valve selectively providing fluid communication between the internal bore and exterior of the internal bore.

An embodiment of a method for disconnecting a tubular string extending from a vessel to a subsea blowout preventer into a subsea well includes the steps of providing a subsea completion test tree (SCTT) comprising: a lower tree portion having a control valve; an upper tree portion separably connected to the lower tree portion at a latch; a circulation valve connected with the upper tree portion; and a retainer valve connected with the upper tree portion between the circulation valve and the latch. Connecting the SCTT in a tubular string, wherein the lower tree portion disposed in the subsea blowout preventer and a lower portion of the tubular string extending from the lower tree portion into the subsea well and an upper portion of the tubular string extends between the vessel and the upper tree portion; closing the control valve; closing the retainer valve; disconnecting the upper tree portion from the lower tree portion; and opening the circulation valve to provide fluid communication between an internal bore of the upper tree portion and an exterior.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
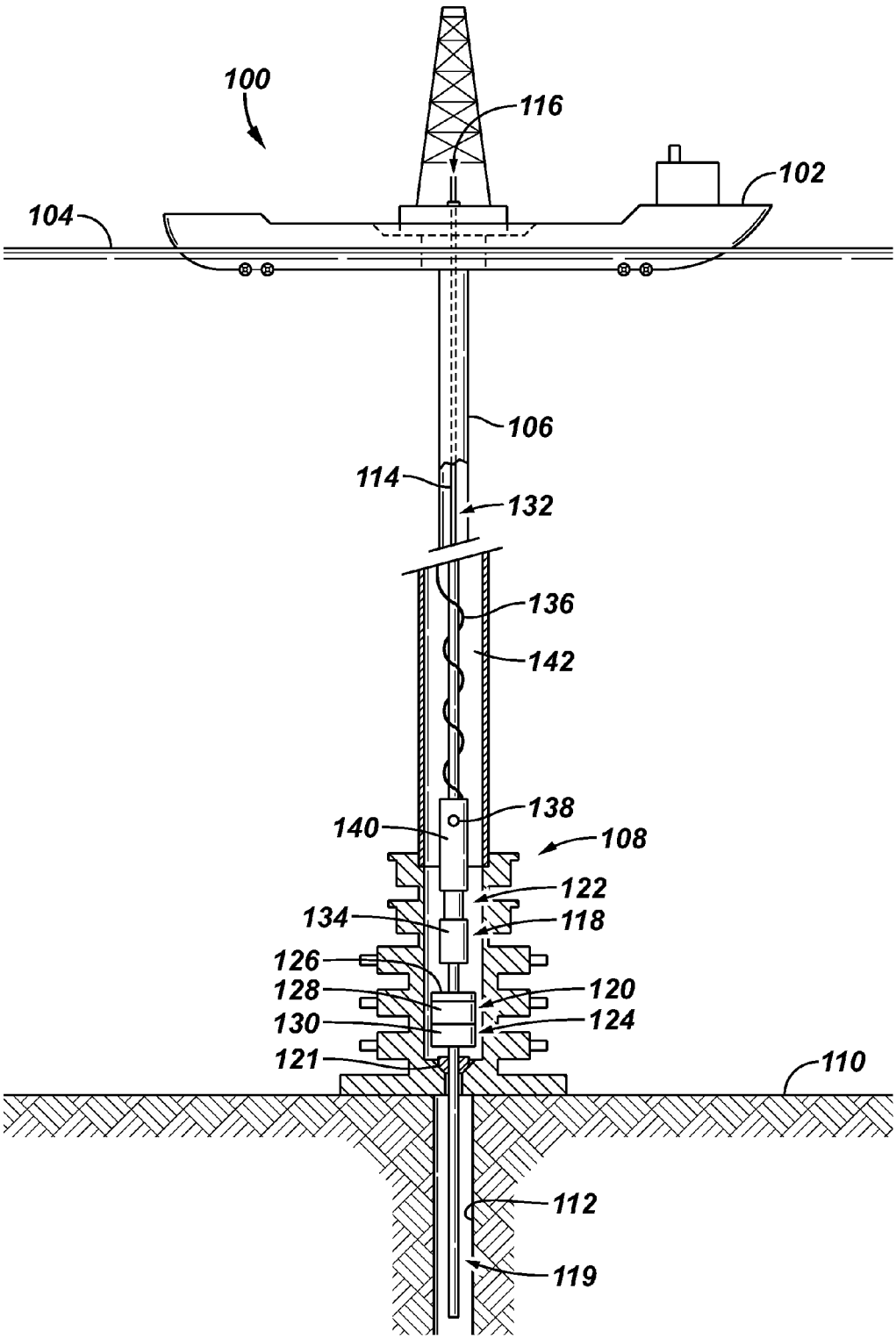
FIG. 1 is a schematic view of a subsea well production system in accordance with an exemplary embodiment of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations, for example the seafloor in a subsea operation.

FIG. 1 illustrates an embodiment of a subsea production well testing system 100 which may be employed to test production characteristics of a well. Subsea production well testing system 100 comprises a vessel 102 which is positioned on a water surface 104 and a riser 106 which connects the vessel 102 to a blowout preventer stack 108 on the seafloor 110. A well 112 has been drilled into the seafloor 110, and a tubing string 114 extends from vessel 102 through the blowout preventer stack 108 into well 112. Tubing string 114 is provided with a bore 116 through which hydrocarbons or other formation fluids can be conducted from well 112 to the surface during production testing of the well. A test device, such as a pressure/temperature sub, may be provided in tubing string 114 to monitor the flow of formation fluids into tubing string 114.

System 100 includes a subsea completion test tree (SCTT), generally denoted by the numeral 118. SCTT 118 includes a lower tree portion 120 and an upper tree portion 122 separable at a latch 126. Lower tree portion 120 is landed in blowout preventer stack 108 on tubing string 114. A lower portion 119 of tubing string 114 is supported by a hanger 121. Lower tree portion 120 includes a valve assembly 124. Valve assembly 124 may act as a master control valve during testing of well 112. Valve assembly 124 may include a normally-closed flapper valve 128 and a normally-closed ball valve 130. Flapper valve 128 and ball valve 130 may be operated in series. Upper tree portion 122 is in fluid connection with the upper portion 132 of tubing string 114 to be disconnected from lower tree portion 120 if desired via latch 126. Upper tree portion 122 includes a retainer valve 134 and bleedoff valve 138. One example of a modular type subsea completion test tree is disclosed in U.S. Pat. No. 6,293,344, the teachings of which are incorporated herein by reference.

In the illustrated embodiment, upper tree portion 122 further includes a circulating valve 140. Circulating valve 140 may provide selective fluid communication between bore 116 of tubing string 114 and the exterior 144 of bore 116 and tubing string 114. Exterior 142 may be an annulus, such as the annulus formed between riser 106 and tubing string 114 and upper tree portion 122 in FIG. 1 or between the tubing string 114, upper tree portion 122 and an outer tubular string for example.

Figure 2:
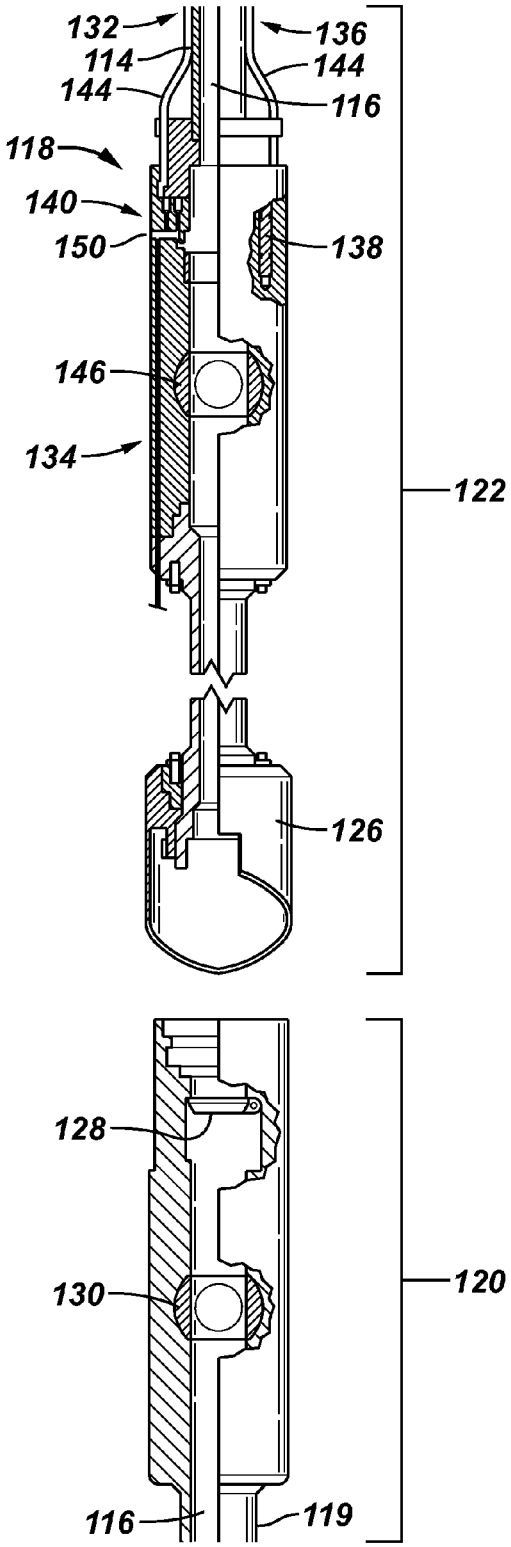
FIG. 2 is a partial cross-section view of a subsea completion test tree in accordance with an exemplary embodiment of the present invention.

Refer now to FIG. 2, wherein a partial cross-sectional view of a SCTT 118 according to an exemplary embodiment is illustrated. An umbilical 136 may provide the fluid pressure necessary to operate various devices of system 100, such as and without limitation, valve assembly 124, latch 126, retainer valve 134, bleedoff valve 138 and circulation valve 140. Umbilical 136 may include, or be in fluid connection, with control lines 144 which provide fluid communication between a pressure source, for example on vessel 102 (FIG. 1), and various devices.

Retainer valve 134 is arranged at the lower end of upper portion 132 of tubing string 114 to prevent fluid in upper portion 132 of the tubing string from draining into riser 106 (FIG. 1) when disconnected from lower tree portion 120. In operation, and with reference to FIG. 1, lower tree portion 120 and retainer valve 134 are landed in blowout preventer stack 108 on tubing string 114. Valves 128 and 130 in lower tree portion 120 and valve element 146 of retainer valve 134 are open to allow fluid flow (e.g., production) from lower portion 119 of tubing string 114 to upper portion 132 of tubing string 114. Valves 128 and 130 can be closed to prevent fluid from flowing from lower portion 119 of tubing string 114 to upper portion 132 of tubing string 114. Once valves 128 and 130 are closed, upper portion 132 of tubing string 114 and upper tree portion 122 may be disconnected from lower tree portion 120 at latch 126.

Before disconnecting upper tree portion 122 from lower tree portion 120, retainer valve 134 is closed by moving the ball element 146 to the closed position. Closed retainer valve 134 prevents fluid from being dumped out of upper portion 132 of tubing string 114. When retainer valve 134 is closed, pressure is trapped between retainer valve 134 and valve assembly 124 of the lower tree portion 120. Bleedoff valve 138 may be operated to equalize the pressure across valve member 146. After equalizing the pressure, latch 126 may be operated to disconnect upper portion 132 of tubing string 114 and upper tree portion 122 from lower tree portion 120.

Figure 3:
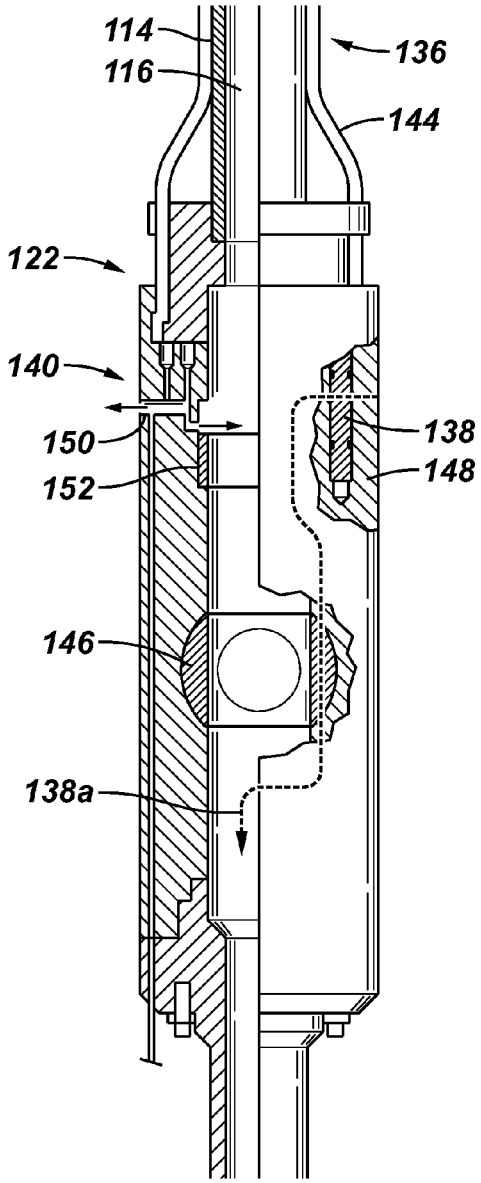
FIG. 3 is a partial cross-section view of an upper tree portion of a subsea completion test tree illustrating a circulation valve in accordance with an exemplary embodiment of the present invention.

Refer now to FIG. 3, wherein a partial cross-sectional view of upper tree portion 122 according to an exemplary embodiment is illustrated. Bleedoff valve 138 is provided in a wall 148 of upper tree portion 122 to provide a fluid path, when open, across valve member 146 as illustrated by the arrow 138*a*. In some embodiments, bleedoff valve 138 may be operated between an open and closed position via a control line 144.

In the illustrated embodiment, circulation valve 140 is positioned proximate to, and above retainer valve 134 and its valve member 146 relative to seafloor 110 (FIG. 1). Circulating valve 140 includes a radial port 150 formed through wall 148 (e.g., housing, mandrel). When open, port 150 provides radial fluid communication between the internal bore 116 and the exterior 142. A valve member, such as a sliding sleeve 152, may be positioned for movement to selectively open and close radial port 150. A control line 144 may be in operational connection with valve member 152 to open and close radial port 150. In the illustrated embodiment, radial port 150 permits a bi-directional fluid flow. Thus, fluid, illustrated by the arrow, can flow from annulus 142 to the interior, bore 116, and vice-versa.

For example, in some instances it may be desired to circulate fluid from annulus 142 formed between an outer tubular (e.g., riser 106) and upper portion 132 of tubular string 114. Fluid may be pumped down annulus 142 through an open circulating valve 140 into bore 116 of tubular string 114. In some embodiments, for example when retrieving upper portion 132 of tubing string 114, it may be desired to circulate fluid from upper portion 132 through circulating valve 140 and up annulus 142 to vessel 102 for example.

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A subsea completion testing tree (SCTT) for connection in a tubular string, the SCTT comprising:

a lower tree portion having a control valve;

an upper tree portion separably connected to the lower tree portion at a latch;

a circulation valve connected with the upper tree portion; and a retainer valve connected with the upper tree portion between the circulation valve and the latch.

2. The SCTT of claim 1, wherein the circulation valve comprises:

a radial port formed through a wall between an internal bore of the upper tree portion and exterior of the upper tree portion; and a valve member moveable between an open position permitting fluid flow between the internal bore and the exterior.

3. The SCTT of claim 2, wherein the valve member is a sliding sleeve.

4. The SCTT of claim 1, wherein the control valve comprises a first valve and a second valve.

5. The SCTT of claim 4, wherein the first valve is a flapper valve and the second valve is a ball valve.

6. The SCTT of claim 1, further comprising a bleedoff valve disposed with the upper tree portion.

7. The SCTT of claim 4, wherein the circulation valve comprises:

a radial port formed through a wall between an internal bore of the upper tree portion and exterior of the upper tree portion; and a valve member moveable between an open position permitting fluid flow between the internal bore and the exterior.

8. The SCTT of claim 7, further comprising a bleedoff valve disposed with the upper tree portion.

9. The SCTT of claim 8, wherein the valve member is a sliding sleeve.

10. The SCTT of claim 6, wherein the circulation valve comprises:

a radial port formed through a wall between an internal bore of the upper tree portion and exterior of the upper tree portion; and a valve member moveable between an open position permitting fluid flow between the internal bore and the exterior.

11. The SCTT of claim 10, wherein the valve member is a sliding sleeve.

12. A subsea well production system, the system comprising:

a subsea completion tree having an upper tree portion and a lower tree portion separably connected at a latch, the lower tree portion landed at a blowout preventer stack at a sea floor;

an upper portion of a tubular string extending from a vessel to the upper tree portion;

a lower portion of the tubular string extending into a well and in fluid connection with the lower tree portion, wherein an internal bore is formed through the tubular string and the subsea completion tree;

a control valve connected in the internal bore with the lower tree portion;

a circulation valve connected in the internal bore with the upper tree portion, the circulation valve selectively providing fluid communication between the internal bore and exterior of the internal bore; and a retainer valve connected in the internal bore with the upper tree portion between the circulation valve and the latch.

13. The system of claim 12, wherein the circulation valve comprises:

a radial port formed through a wall between the internal bore of the upper tree portion and exterior of the upper tree portion; and a valve member moveable between an open position permitting fluid flow between the internal bore and the exterior.

14. The SCTT of claim 13, wherein the valve member is a sliding sleeve.

15. The SCTT of claim 12, wherein the control valve comprises a first valve and a second valve.

16. The SCTT of claim 15, wherein the first valve is a flapper valve and the second valve is a ball valve.

17. The SCTT of claim 12, further comprising a bleedoff valve disposed with the upper tree portion.

18. The SCTT of claim 14, further comprising:

a bleedoff valve disposed with the upper tree portion; and wherein the control valve comprises a flapper valve and a ball valve.

19. A method for disconnecting a tubular string extending from a vessel to a subsea blowout preventer into a subsea well, comprising:

connecting a subsea completion test tree (SCTT) in the tubular string, wherein the SCTT comprises a lower tree portion having a control valve; an upper tree portion separably connected to the lower tree portion at a latch; a circulation valve connected with the upper tree portion; and a retainer valve connected with the upper tree portion between the circulation valve and the latch; wherein the lower tree portion is disposed in the subsea blowout preventer and a lower portion of the tubular string extends from the lower tree portion into the subsea well and an upper portion of the tubular string extends between the vessel and the upper tree portion;

closing the control valve;

closing the retainer valve;

disconnecting the upper tree portion from the lower tree portion; and opening the circulation valve to provide fluid communication between an internal bore of the upper tree portion and an exterior.

20. The method of claim 19, wherein the circulation valve comprises:

a radial port formed through a wall between the internal bore of the upper tree portion and exterior of the upper tree portion; and a valve member moveable between an open position permitting fluid flow between the internal bore and the exterior.

* * * * *